United States Patent [19]

Adams et al.

[11] Patent Number: 4,712,996

[45] Date of Patent: Dec. 15, 1987

[54] GAS BURNER CONTROL SYSTEM WITH MASS FLOW SENSOR

[75] Inventors: John T. Adams, St. Louis; John B. Goodale, St. Charles County, both of Mo.

[73] Assignee: Emerson Electric Co., St. Louis, Mo.

[21] Appl. No.: 933,558

[22] Filed: Nov. 21, 1986

[51] Int. Cl.[4] ..... F23N 3/00

[52] U.S. Cl. ..... 431/20; 431/89; 73/204

[58] Field of Search ..... 431/20, 89, 80; 73/204; 236/11; 237/55

[56] References Cited

U.S. PATENT DOCUMENTS

| | | | |
|---|---|---|---|
| 3,988,928 | 11/1976 | Edstrom | 73/204 |
| 3,992,940 | 11/1976 | Platzer, Jr. | 73/204 |
| 4,067,233 | 1/1978 | Obayashi et al. | 73/204 |
| 4,125,093 | 11/1978 | Platzer, Jr. | 123/32 EA |
| 4,255,968 | 3/1981 | Harpster | 73/204 |
| 4,340,355 | 7/1982 | Nelson et al. | 431/20 |
| 4,399,697 | 8/1983 | Kohama et al. | 73/204 |
| 4,477,019 | 10/1984 | Breitbach | 431/20 |

FOREIGN PATENT DOCUMENTS

| | | | |
|---|---|---|---|
| 2138566 | 10/1984 | United Kingdom | 73/204 |

*Primary Examiner*—Samuel Scott
*Assistant Examiner*—Noah Kamen
*Attorney, Agent, or Firm*—Paul A. Becker, Sr.

[57] ABSTRACT

A gas burner control system for controlling operation of a furnace having a blower fluidically connected to the combustion chamber of the furnace utilizes a mass flow sensor for preventing or discontinuing burner operation in the event of a blower failure or a predetermined degree of blockage in the fluid flow path controlled by the blower. The mass flow sensor includes circuit means which enables use of unmatched sensors, enables establishing of a desired value of temperature difference between sensors, enables establishing a temperature difference that is not constant so as to compensate for different ambient air densities, and enables compensating for voltage variations at different ambient air temperatures.

12 Claims, 7 Drawing Figures

--RELAY COIL 80 ENERGIZED
--RELAY COIL 80 DE-ENERGIZED
192 (FULL FLOW)
194 (NO FLOW)
VOLTAGE (VOLTS) AT JUNCTION 182
TIME (SECONDS)
T1
T3 T4
T2

42
48
50
52
66
126
128
130
132
134
136
138
140
142
144
146
148

GAS BURNER CONTROL SYSTEM WITH MASS FLOW SENSOR

BACKGROUND OF THE INVENTION

This invention relates to gas burner control systems, and particularly to an improved gas burner control system for gas fired furnaces of the induced draft or forced combustion types.

An induced draft furnace, sometimes referred to as a powered vent furnace, utilizes a small blower connected in an exhaust passageway of the combustion chamber for drawing air into the combustion chamber to provide a combustible air-gas mixture to the burner, and for discharging the products of combustion through the flue to the atmosphere. A forced combustion furnace utilizes a small blower connected in an intake passageway to the combustion chamber for drawing in air and forcing it into the combustion chamber to provide a combustible air-gas mixture to the burner, and for forcing the products of combustion out through the flue to the atmosphere. In either type, the air drawn in may be ambient air surrounding the furnace or outside air provided through a conduit connected between the furnace and air outside the dwelling.

In either furnace type, it has been conventional, for safety reasons, to provide control means for preventing or discontinuing burner operation in the event of a blower failure or a blockage in the intake air passageway or the exhaust flue. While such control means have taken many forms, the most commonly used control means appears to be devices of the pressure sensitive type. Such pressure sensitive control devices are constructed and arranged to sense pressure or pressure variations in the fluid path controlled by the blower, and to prevent or discontinue burner operation when the sensed pressures are outside predetermined values.

Such pressure sensitive control devices typically include a diaphragm and cooperative mechanically operated electrical switch. The device is responsive to pressure on the diaphragm, and as such, cannot distinguish between variations in pressure caused by actual changes in fluid flow velocity due to, for example, a partially blocked flue, from variations in pressure caused by, for example, a change in the density of the fluid in the fluid-flow path. Also, such a device must allow for various tolerances which will affect operation, such as tolerances in the differential of the mechanically operated electrical switch. Therefore, when such a device is calibrated, the above factors are considered, and the sensitivity of the device to degrees of blockage in the fluid flow path is compromised. Also, in such a device, one side of the diaphragm is connected by a hose to the area in which the pressure to be measured exists. In some applications, such as in some furnaces of high operating efficiency, wherein water condensate is produced, there is a tendency for such condensate to settle in the hose. Such water condensate in the hose is undesirable since it changes the operating pressures of the device. While this problem can be alleviated by proper location of the device or by providing an air vent in the hose, it is believed more desirable to provide a device which is not susceptible to such water condensate and thus can be mounted in the most convenient and economical location.

SUMMARY OF THE INVENTION

A primary object of this invention is to provide a generally new and improved gas burner control system for gas fired furnaces of the induced draft or forced combustion types wherein burner operation is controlled by a mass flow sensor.

A further object is to provide such a gas burner control system wherein a mass flow sensing circuit includes a sensing device connected fluidically in an air flow path between ambient air and a low pressure portion of a fluid flow path controlled by a blower, whereby ambient air is caused to flow through the sensing device when the blower is operating; wherein the sensing device includes a first temperature sensitive sensor responsive to the temperature of ambient air and a second temperature sensitive sensor responsive to heat produced by a heating means; wherein the air flow through the sensing device causes a transfer of heat from the second sensor to the moving air; wherein the mass flow sensing circuit further includes circuit means for initiating energizing of the blower, for energizing the heating means to establish a predetermined temperature difference between the first and second sensors, for providing a characteristic value indicative of the degree of energizing of the heating means, and for effecting burner operation when the degree of energizing of the heater means is the degree required to establish the predetermined temperature difference in the presence of the proper value of mass flow of air through the sensing device.

A further object is to provide such a gas burner control system as in the preceding paragraph wherein the circuit means in the mass flow sensing circuit enables using sensing devices wherein the first and second temperature sensitive sensors have different thermal characteristics.

A further object is to provide such a gas burner control system as in the penultimate paragraph wherein the circuit means in the mass flow sensing circuit enables establishing a temperature difference that is not constant between the first and second sensors so as to compensate for differences in heat transfer from the second sensor to the moving air at different ambient temperatures.

The above mentioned and other objects and features of the present invention will become apparent from the following description when read in conjunction with the accompanying drawings.

DESCRIPTION OF THE PREFERRED EMBODIMENT

Figure 1:
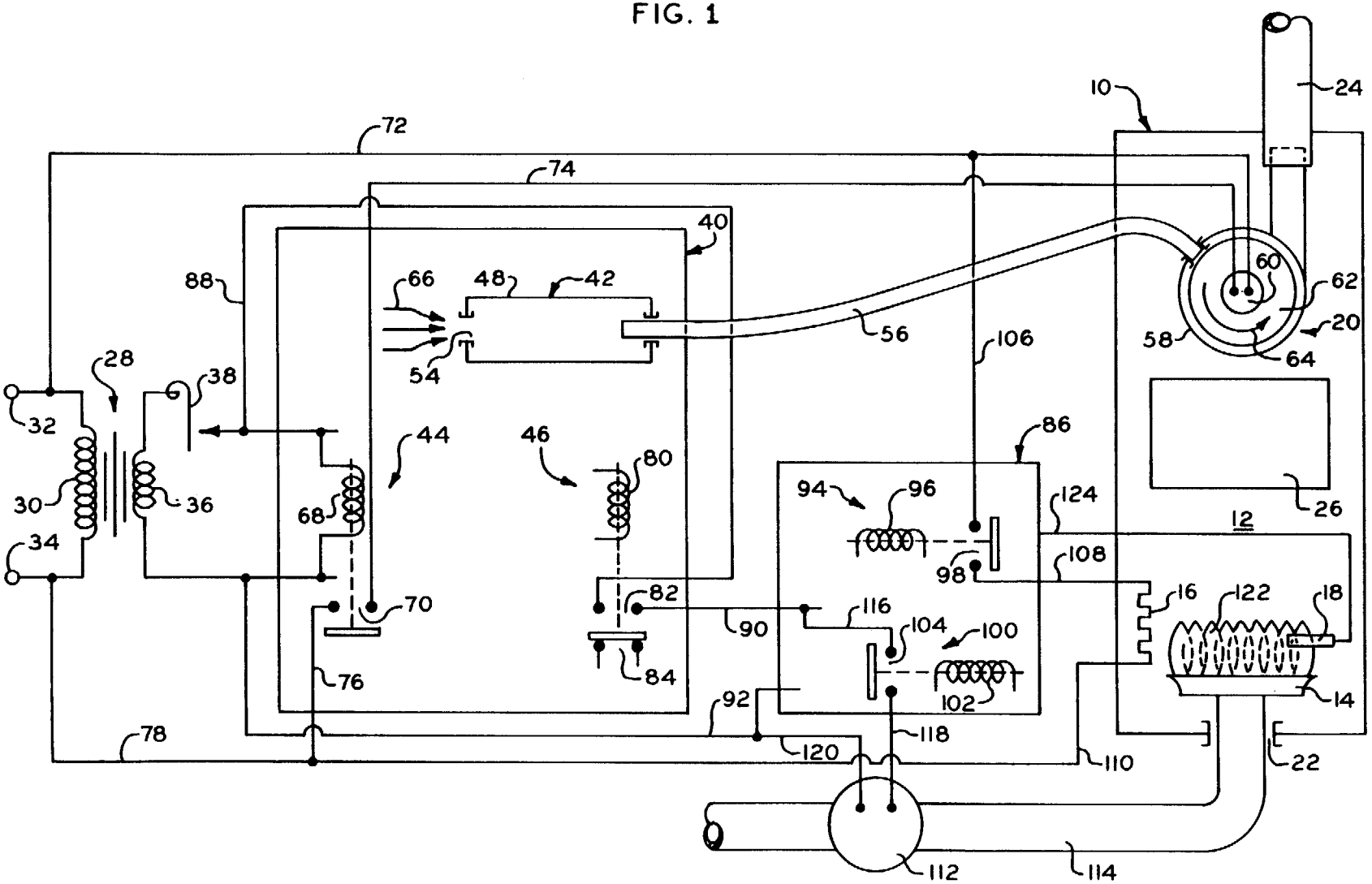
FIG. 1 is a diagrammatic illustration of a gas burner control system constructed in accordance with the present invention.

Referring to FIG. 1, the gas burner control system of the present invention controls operation of an induced draft furnace shown partially at 10. Furnace 10 includes a combustion chamber 12 in which a burner 14, an igniter 16, and a flame probe 18 are positioned. A blower 20 is in fluidic connection with combustion chamber 12, and is effective to draw ambient air into combustion chamber 12 through a combustion chamber opening 22, and to exhaust products of combustion out of combustion chamber 12 to atmosphere through a flue 24. A plenum 26 is in heat transfer relationship with combustion chamber 12 for providing warm air that is distributed to the dwelling by means of a blower (not shown). It is to be understood that, alternatively, the furnace could be of the forced combustion type, wherein blower 20 would be located in an intake passageway to combustion chamber 12 so as to draw in ambient air and force it into combustion chamber 12, and force the products of combustion out through flue 24 to atmosphere.

The gas burner control system includes a voltage step-down transformer 28 having a primary winding 30 connected to terminals 32 and 34 of a conventional 120 volt alternating current power source. The secondary winding 36 is connected through a thermostat 38 to a mass flow sensing circuit 40 so as to provide a 24 volt alternating current power source for mass flow sensing circuit 40 whenever thermostat 38 is closed.

Mass flow sensing circuit 40, which will be hereinafter described in more detail, includes a sensing device 42 and relays 44 and 46.

Figure 2:
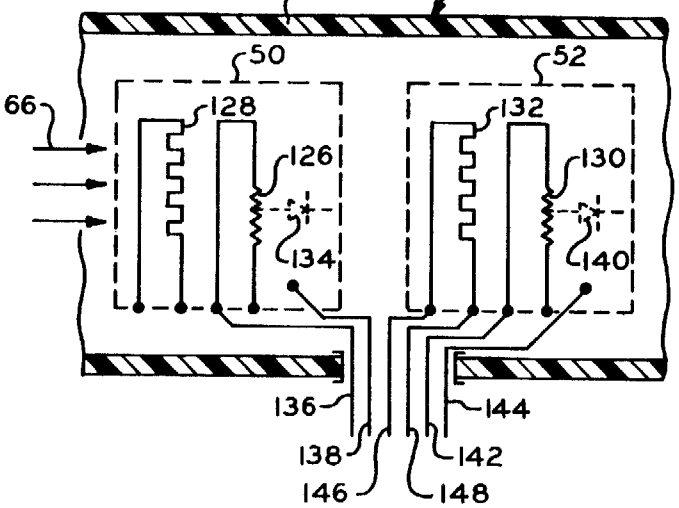
FIG. 2 is a partial cross-sectional view of the sensing device utilized in the system of FIG. 1.

Sensing device 42 includes a tubular housing 48 in which a pair of sensing members 50 and 52, shown in FIG. 2, are positioned. One end of housing 48 is exposed to ambient air through an opening 54, and the other end is connected through a flexible hollow tube 56 to the interior of housing 58 of blower 20 which includes a motor 60 and a blower wheel 62. When motor 60 is energized, blower wheel 62 is rotated in a counterclockwise direction as shown by arrow 64, thus producing a low pressure condition in the interior of housing 58 in the area in which tube 56 is connected to housing 58. This low pressure causes ambient air, indicated by arrows 66, to be drawn in into sensing device 42 and across sensing members 50 and 52.

Relay 44 in mass flow sensing circuit 40 includes a coil 68 and a set of normally-open contacts 70. When coil 68 is energized, contacts 70 are closed, enabling blower motor 60 to be energized by the 120 volt power source at terminals 32 and 34, the circuit being: from terminal 32 through a lead 72, blower motor 60, a lead 74, closed contacts 70, and leads 76 and 78 to terminal 34.

Relay 46 in mass flow sensing circuit 40 includes a coil 80, a set of normally-open contacts 82, and a set of normally-open contacts 84. When coil 80 is de-energized, normally-closed contacts 84 are utilized in an auxiliary circuit (not shown). When coil 80 is energized, normally-open contacts 82 are closed, enabling a burner control module, shown generally at 86, to be energized by the 24 volt power source at secondary winding 36, the circuit being: from one end of secondary winding 36 through thermostat 38, a lead 88, closed contacts 82, a lead 90, burner control module 86, and a lead 92 to the other end of secondary winding 36.

When burner control module 86 is energized, it effects burner operation. Burner control module 86 may be of various types shown in the prior art but is preferably of the type shown in the Bernard T. Brown U.S. Pat. No. 4,615,282 which issued Oct. 7, 1986. In accordance with the referenced type, burner control module 86 includes an igniter relay 94 comprising a coil 96 and a set of normally-open contacts 98, a valve relay 100 comprising a coil 102 and a set of normally-open contacts 104, and circuit means (not shown) for controlling operation of relays 94 and 100. When igniter relay 94 is energized, igniter 16 is energized by the 120 volt power source at terminals 32 and 34 through lead 72, a lead 106, closed contacts 98, a lead 108, igniter 16, a lead 110, and lead 78. When valve relay 100 is energized, normally-open contacts 104 are closed, enabling a gas valve 112, which controls the flow of gas in a gas conduit 114 leading from a gas source to burner 14, to be energized by the 24 volt power source at secondary winding 36, the circuit being: from one end of secondary winding 36 through thermostat 38, lead 88, closed contacts 82 of relay 46, lead 90, a lead 116, closed contacts 104, a lead 118, valve 112, a lead 120, and lead 92 to the other end of secondary winding 36. Flame probe 18, which is located with respect to burner 14 so as to be impinged by a burner flame 122, is connected by a lead 124 to burner control module 86.

Operation of the gas burner control system of FIG. 1 will be better understood after the details of mass flow sensing circuit 40 are described.

The basic concept utilized in mass flow sensing circuit 40 is having two temperature sensitive devices in an air flow path wherein one of the devices is sensitive to ambient air temperature, the other device is heated to a predetermined temperature above the ambient air temperature, and the power required to maintain the predetermined temperature difference between the two devices is an indication of whether there is adequate mass flow in the air flow path. While the sensing device 42 utilized in the mass flow sensing circuit 40 may take several forms, a construction which has been found to provide satisfactory results is illustrated in FIG. 2.

In FIG. 2, sensing member 50 comprises a solid state chip (indicated by dotted lines) fabricated from a sillcon wafer. The substrate material is n-type. P-type material is diffused into the substrate to form a resistor 126. The chip surface is then glass-passivated and nichrome is evaporated onto the passivated surface to form a heater 128. Sensing member 52 is identically constructed, having a resistor 130 and a heater 132 identical to the resistor 126 and heater 128 of sensing member 50.

Sensing member 50 contains the device sensitive to ambient air temperature. Heater 128 is not utilized in sensing member 50. Although heater 128 is not utilized, it is believed to be more economical, from the viewpoints of production, stocking, handling, and assembling, that sensing members 50 and 52 be identically constructed. Also, it has been determined that the temperature coefficient of resistance of resistor 126, while adequate for some applications, is not linear in the entire range of ambient temperatures in which the gas burner control system of the present invention is to be operable, to enable resistor 126 to be used as the ambient temperature sensitive sensor. It has been found, however, that the inherent diode structure formed by the p-type material resistor 126 and the n-type material substrate, shown as diode 134 in phanton, provides a temperature coefficient of forward voltage drop that is linear in the required range of ambient temperatures. Therefore, diode 134, rather than resistor 126, is utilized as the ambient temperature sensitive sensor. Diode 134, hereinafter referred to as the ambient sensor, is connected to circuitry in mass flow sensing circuit 40 by a lead 136, which is connected to resistor 126, and by a lead 138, which is connected to the chip substrate of sensing member 50.

Sensing member 52 contains the device which is heated to a predetermined temperature above the ambient temperature. Specifically, as in sensing member 50, the p-type material resistor 130 and the n-type material substrate in sensing member 52 provide an inherent diode structure, shown as diode 140 in phantom. As with diode 134, the temperature coefficient of the forward voltage drop of diode 140 is linear. Diode 140, hereinafter referred to as the air flow sensor, is connected to circuitry in mass flow sensing circuit 40 by a lead 142, which is connected to resistor 130, and by a lead 144, which is connected to the chip substrate of sensing member 52. Heater 132 is connected to circuitry in mass flow sensing circuit 40 by leads 146 and 148. When energized, heater 132 heats the chip of sensing member 52. The heat is conducted to diode 140, causing the temperature of diode 140 to increase. Sensing members 50 and 52 are spaced sufficiently from each other so that the heat generated by heater 132 in sensing member 52 has no effect on the ambient sensor 134 in sensing member 50.

Figure 3A:
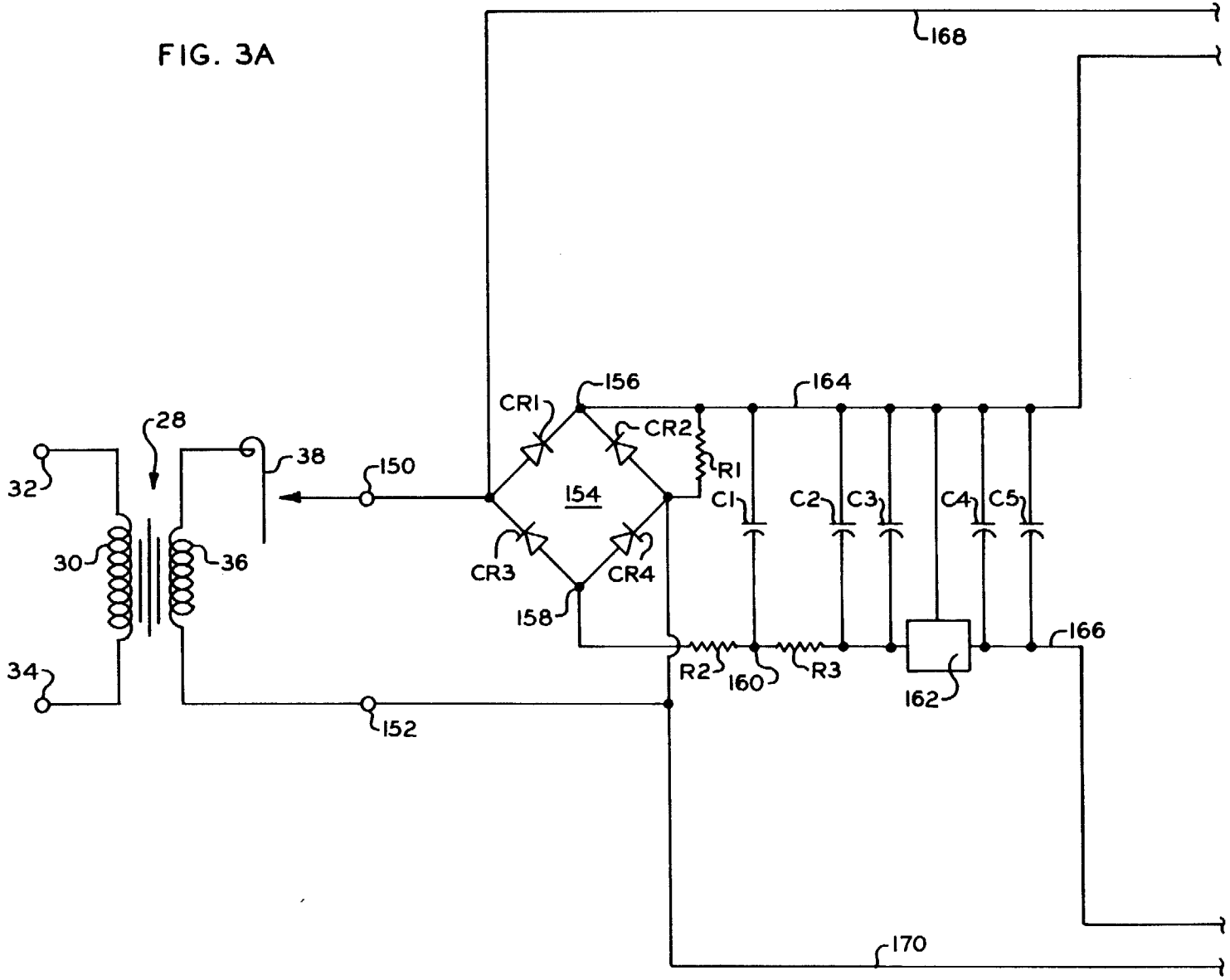
FIGS. 3A and 3B, when combined, is a diagrammatic illustration of the mass flow sensing circuit of FIG. 1.
Figure 3B:
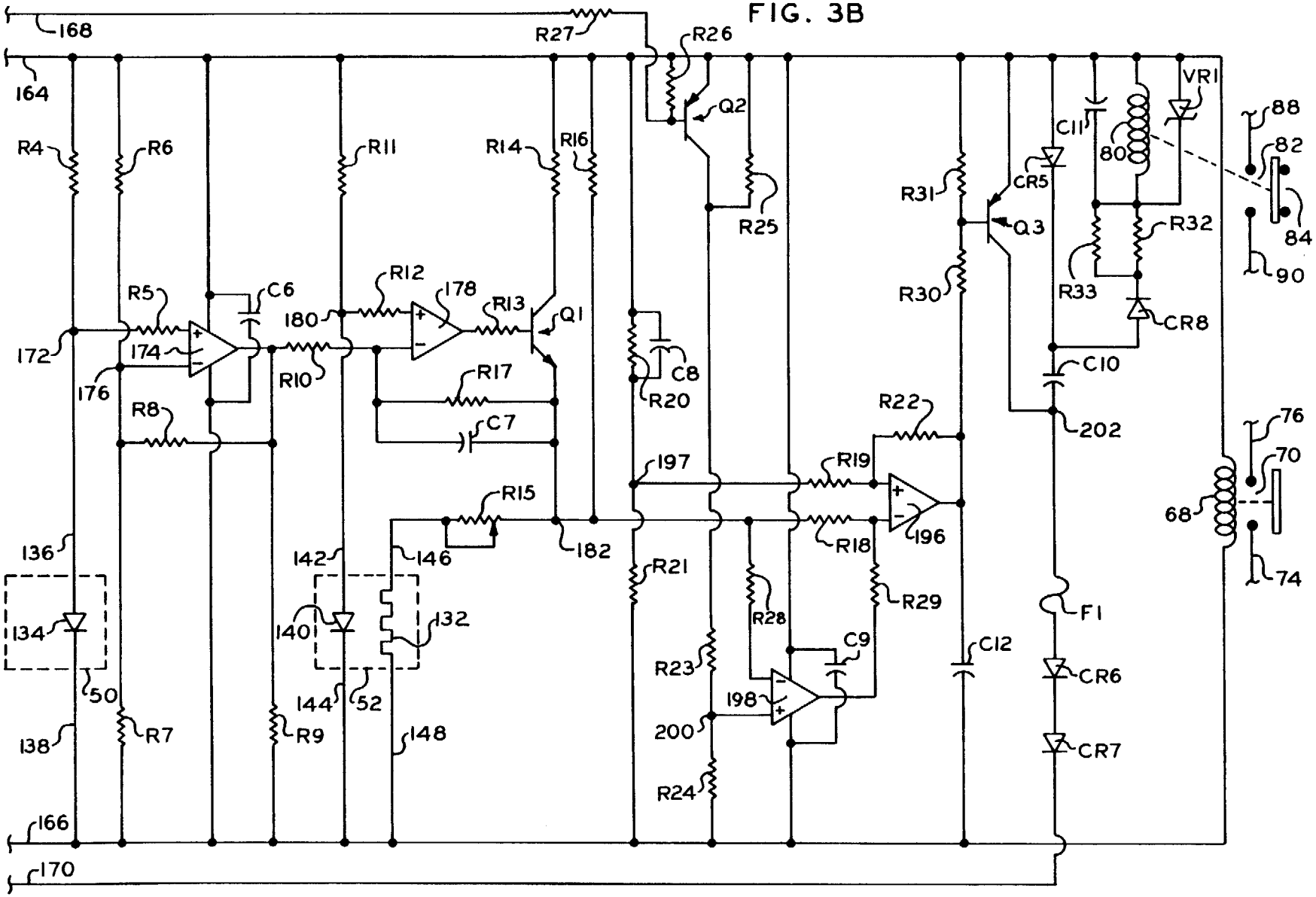

Referring to FIGS. 3A and 3B, mass flow sensing circuit 40, illustrated therein, is connected to terminals 150 and 152 so as to be energized by the 24 volt alternating current power source provided by secondary winding 36 of transformer 28 whenever thermostat 38 is closed.

Referring to FIG. 3A, a full wave bridge 154, comprising rectifiers CR1, CR2, CR3, and CR4 is connected across terminals 150 and 152. A resistor R1 is connected across rectifier CR2 to provide a reference to one side of the alternating current power source at terminal 152. Connected in series between the junction 156 of rectifiers CR1 and CR2 and the junction 158 of rectifiers CR3 and CR4 are a series connected capacitor C1 and current limiting resistor R2. Connected in series between junction 156 and the junction 160 of capacitor C1 and resistor R2 are a series connected capacitor C2 and a current limiting resistor R3. Capacitors C1 and C2 function to filter the unidirectional flow through bridge circuit 154.

A negative 15 volt regulator 162 is connected between resistor R3 and a lead 164, which is connected to bridge circuit junction 156, so as to provide a potential on its output lead 166 which is 15 volts negative with respect to lead 164. A capacitor C3, connected between lead 164 and the input of regulator 162, and a capacitor C4, connected between lead 164 and the output of regulator 162, function to prevent regulator 162 from oscillating. A capacitor C5 is connected between leads 164 and 166 as a transient suppressor. A lead 168 is connected to terminal 150, and a lead 170 is connected to terminal 152 for purposes to be hereinafter described.

Referring to FIG. 3B, ambient sensor 134 is connected in series with a biasing resistor R4 between leads 164 and 166. The junction 172 between resistor R4 and ambient sensor 134 is connected through a resistor R5 to the non-inverting input terminal of an operational amplifier 174. The inverting input terminal of operational amplifier 174 is connected to the junction 176 of resistors R6 and R7 which are connected in series between leads 164 and 166.

The output of operational amplifier 174 is connected through a feedback resistor R8 to its inverting input terminal, through a resistor R9 to lead 166, and through a resistor R10 to the inverting input terminal of a second operational amplifier 178. Preferably, operational amplifiers 174 and 178 are integrated in a single device such as an LM 358. A capacitor C6, illustrated as connected across the power leads of operational amplifier 174, functions as a noise suppressor for both operational amplifiers 174 and 178.

Air flow sensor 140 is connected in series with a biasing resistor R11 between leads 164 and 166. The junction 180 between resistor R11 and air flow sensor 140 is connected through a resistor R12 to the non-inverting input terminal of operational amplifier 178.

The output of operational amplifier 178 is connected through a current limiting resistor R13 to the base of an NPN transistor Q1. The collector of transistor Q1 is connected through a current limiting resistor R14 to lead 164. The emitter of transistor Q1 is connected to lead 166 through an adjustable resistor R15 and heater 132 of sensing member 52. A current limiting resistor R16 is connected in parallel with the series connected resistor R14 and transistor Q1. A resistor R17 and a capacitor C7 are connected in parallel between the emitter of Q1, also identified as junction 182, and the inverting input terminal of operational amplifier 178.

Figure 4:
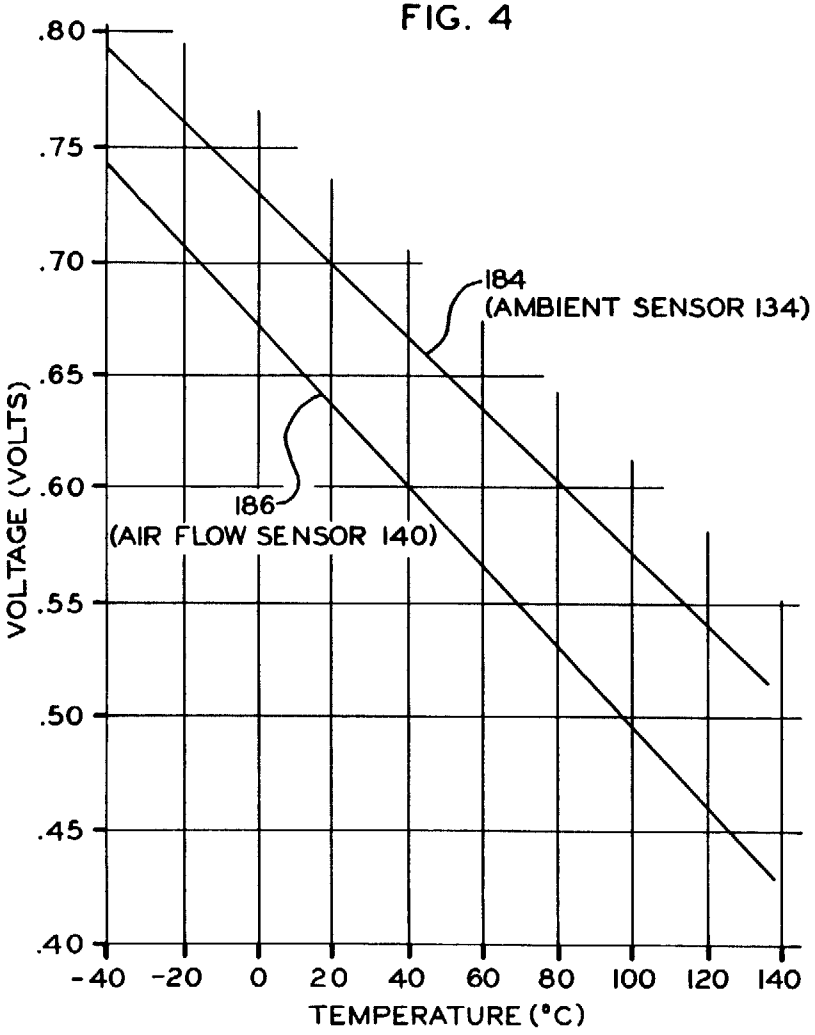
FIG. 4 is a chart depicting the temperature coefficient of forward voltage drop of sensing diodes utilized in the mass flow sensing circuit.

As previously described, the temperature coefficient of the forward voltage drop of sensors 134 and 140 is linear. Referring to FIG. 4, curves 184 and 186 illustrate the temperature coefficient of the forward voltage drop of ambient sensor 134 and air flow sensor 140, respectively. These curves are generated with sensors 134 and 140 energized through resistors R4 and R11, respectively. Resistor R11 is twice the resistance value of resistor R4, causing the absolute value of voltage across air flow sensor 140 at a given temperature to be less than that across ambient sensor 134. It is to be noted that as evidenced by the slope of curve 186 being greater than the slope of curve 184, the rate of change in voltage with respect to temperature is greater in air flow sensor 140 than in ambient sensor 134. This characteristic, which is apparently inherently effected by the lower biasing current through air flow sensor 140 than through ambient sensor 134, matches the gain characteristics of operational amplifier 174 so that it functions properly. That is to say, for operational amplifier 174 to function properly, it must have a gain greater than 1. A gain greater than 1 is ensured by selecting the proper values of resistors R6, R7, and R8. The characteristic of the rate of change in voltage with respect to temperature being greater in air flow sensor 140 than in ambient sensor 134 is compatible with such a gain. For reasons not fully understood, it has been observed that this required characteristic, that the rate of change in voltage must be greater in air flow sensor 140 than in ambient sensor 134, can also be provided by making the area of the air flow sensing member 52 considerably larger, for example, ten times larger, than the area of the ambient sensing member 50.

Even if sensors 134 and 140 are identically constructed, they may possess slightly different voltage versus temperature characteristics. So long as sensors 134 and 140 meet the above requirement regarding rate of change in voltage, they can be utilized in the circuitry of the present invention. That is to say, the circuitry of the present invention can be used with sensors 134 and 140 that are not matched.

The function of operational amplifier 178 is to control conduction of transistor Q1 so as to provide the required amount of current flow through heater 132 to effect a temperature in air flow sensor 140 that is a predetermined amount above ambient sensor 134. Since the voltage on the non-inverting input terminal of operational amplifier 178 is determined by the voltage across air flow sensor 140, and the voltage on the inverting input terminal of operational amplifier 178 is determined by the output of operational amplifier 174, a definite relationship must be established between the voltages across sensors 134 and 140 to effect such function.

Figure 5:
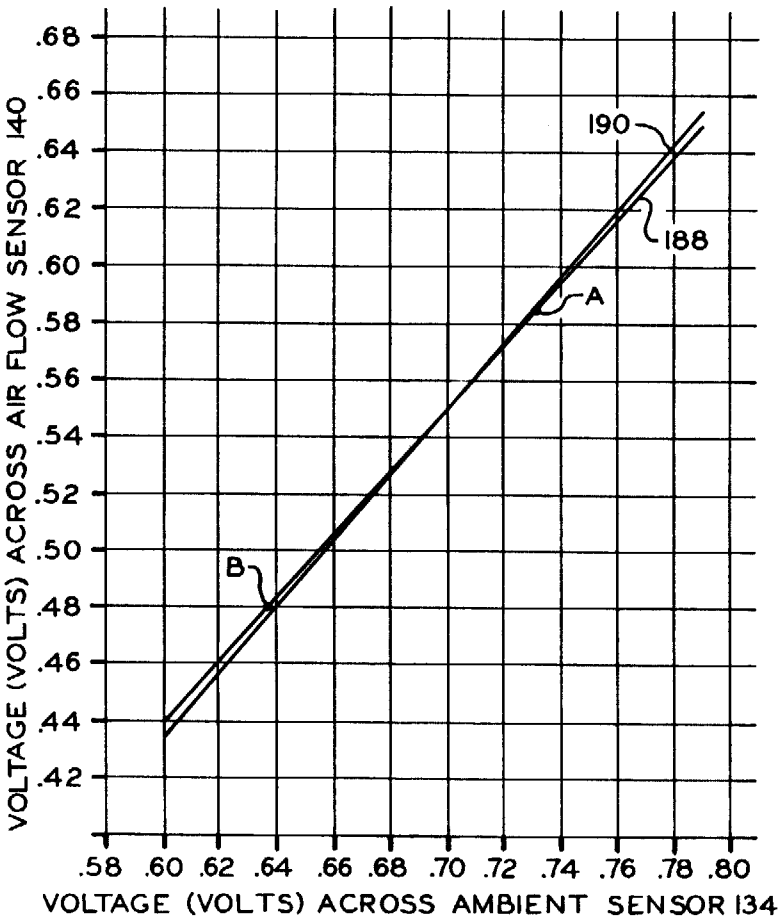
FIG. 5 is a chart depicting voltage relationships of the sensing diodes having the characteristics depicted in FIG. 4.

Referring to FIG. 5, curve 188 illustrates the relationship between the voltages across sensors 134 and 140 when air flow sensor 140 is 50° C. above the temperature of air flow sensor 134. Curve 188 is generated from curves 184 and 186 of FIG. 4. For example, from FIG. 4, at 0° C. ambient, the voltage across ambient sensor 134 is 0.73 volts. Since air flow sensor 140 is to be 50° C. above the ambient temperature, the voltage across air flow sensor 140, at 50° C. above 0° C., is 0.584. These two values define point A on curve 188 in FIG. 5. Similarly, from FIG. 4, at 60° C. ambient, the voltage across ambient sensor 134 is 0.635, and the voltage across air flow sensor 140, at 110° C., which is 50° C. above 60° C., is 0.48. These two values define point B on curve 188. After curve 188 of FIG. 5 is generated, the necessary values of resistors R6, R7, and R8 to produce the voltage relationship of curve 188, can be mathematically determined.

Thus, once the values of resistors R6, R7, and R8 are determined, amplifiers 174 and 178 will function to effect such biasing of transistor Q1 that will enable transistor Q1 to provide for the amount of current flow through heater 132 required to enable heater 132 to heat air flow sensor 140 to a temperature 50° C. above the temperature of ambient sensor 134.

As will hereinafter be described, the voltage value at junction 182 is a circuit parameter utilized to control operation of relay coil 80. To this end, when heater 132 is energized to effect the above 50° C. temperature difference, resistor R15 is adjusted so as to establish a specific desired voltage value at junction 182.

It should be noted that temperature differences other than 50° C. can be utilized. For example, some applications, because of the particular velocity of the fluid flow or because of the heat transfer characteristics of the particular fluid involved, may dictate use of different values of temperature difference. Whatever the temperature difference is to be, the values of resistors R6, R7, and R8 are determined so as to produce the voltage relationship of the sensors 134 and 140 which exists at the chosen value of temperature difference, thus enabling the required energizing of heater 132 to effect the chosen temperature difference.

While maintaining a temperature difference between ambient sensor 134 and air flow sensor 140 that is constant at for example, 50° C., is generally acceptable, it is preferable to slightly modify the temperature difference to allow for differences in heat conduction and heat transfer at different ambient temperatures. Specifically, as will hereinafter be described, the degree of energizing of heater 132, as monitored at junction 182, indicates whether the mass flow through sensing device 42 is proper. It has been determined that the degree of energizing of heater 132 to maintain a constant temperature difference between sensors 134 and 140, which degree of energizing varies in proportion to velocity of the air flow, will also vary as the ambient temperature varies. That is to say, the heat conduction in sensing element 52 to air flow sensor 140 as heater 132 is energized, and the heat transfer from sensing element 52 to the air moving across it, will vary, not only as a result of different flow velocities, but also as a result of different air densities at different ambient temperatures. In the example of a 50° C. temperature difference, to compensate for this condition, it is preferable to provide a slightly smaller than 50° C. temperature difference, for example, 47° C., between sensors 134 and 140 at the lowest anticipated ambient temperature of −40° C., and a slightly greater than 50° C. temperature difference, for example, 53° C., at the highest anticipated ambient temperature of 80° C. Accordingly, it is preferable that the relationship between the voltages across sensors 134 and 140 be as shown by curve 190 in FIG. 4. Therefore, preferably, values of resistors R6, R7, and R8 are determined so as to produce curve 190 rather than curve 188.

It has been observed that the voltage output of voltage regulator 162 varies somewhat with temperature. The determination of the values of resistors R6, R7, and R8 also includes a compensating factor for this voltage variation.

Thus, the properly determined values of resistors R6, R7, and R8 enables using ambient sensors and air flow sensors which have different voltage-temperature characteristics, that is, sensors which are not matched, enables the establishing of a desired value of a constant temperature difference between ambient sensor 134 and air flow sensor 140, enables the establishment of a temperature difference between ambient sensor 134 and air flow sensor 140 that is somewhat less than constant so as to compensate for differences in air density at different ambient temperatures, and enables compensation for differences in output voltage of voltage regulator 162 at different ambient temperatures.

In operation, operational amplifier 178 controls conduction of transistor Q1. When thermostat 38 closes, enabling mass flow sensing circuit 40 to be energized, the output voltage of operational amplifier 174, which is applied through resistor R10 to the inverting input terminal of operational amplifier 178, is less than the voltage at the non-inverting input terminal of operational amplifier 178. Transistor Q1 is therefore biased on through current limiting resistor R13, enabling more current to flow through heater 132. It is noted that some amount of current always flows through heater 132 due to resistor R16. Resistor R16 functions to reduce the power requirements of transistor Q1.

Figure 6:
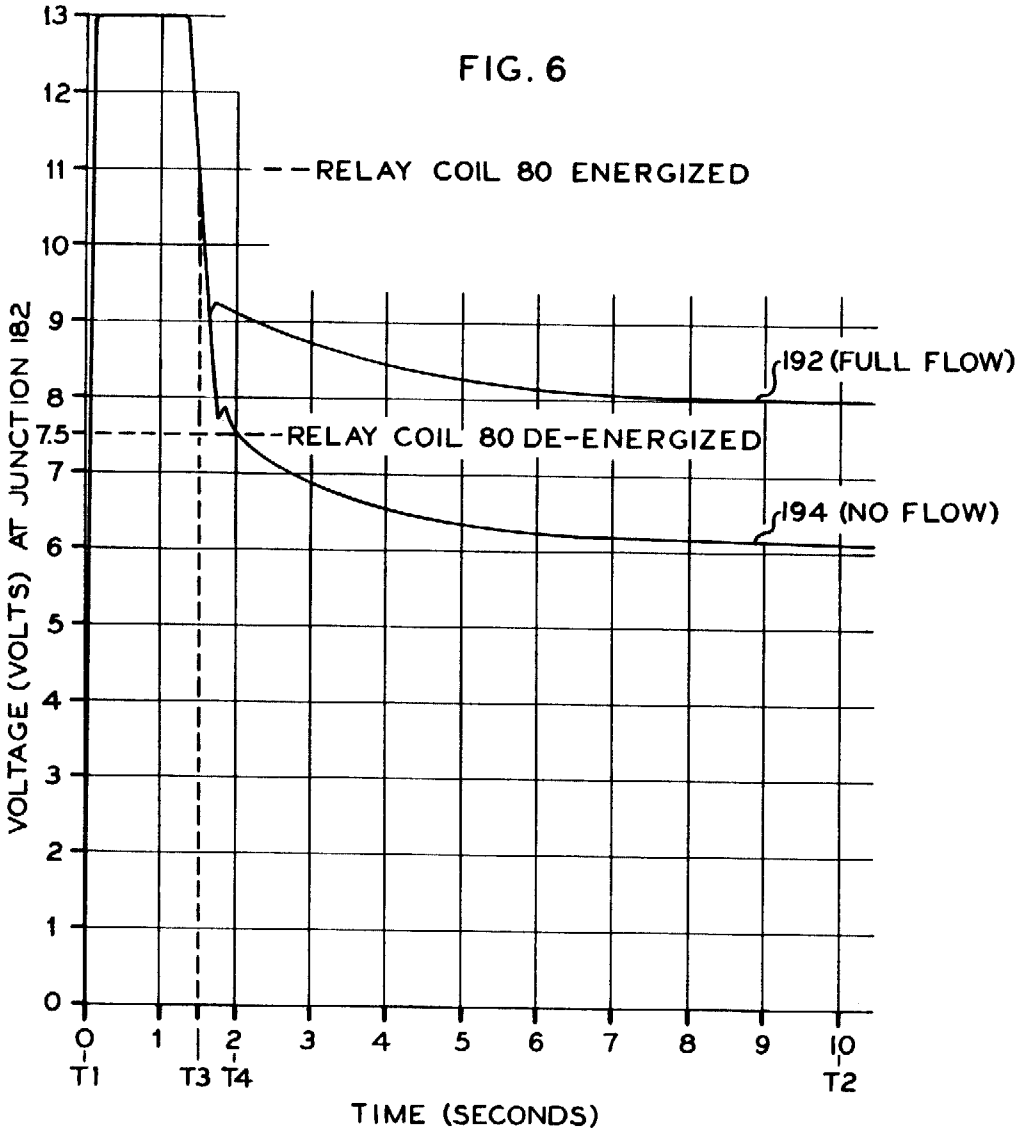
FIG. 6 is a voltage-time chart depicting voltage values generated in the mass flow sensing circuit.

Referring to FIG. 6, wherein T1 represents the time at which thermostat 38 closes, a maximum voltage of approximately 13 volts appears almost immediately at junction 182. Heater 132 heats the chip of sensing member 52 which conducts heat to air flow sensor 140. The temperature of air flow sensor 140 increases and, as illustrated at curve 186 in FIG. 4, the voltage thereacross decreases. When the voltage across air flow sensor 140 is essentially the same as the voltage on the inverting input terminal of operational amplifier 178, operational amplifier 178 has decreased its output, thus decreasing the biasing of transistor Q1 which, in turn, has caused the current through heater 132 to decrease and thus the voltage at junction 182 to decrease. Capacitor C7 and resistor R17, which provide an error integration function, determine the rate at which the voltage at junction 182 changes. If a proper value of air flow exists, the voltage at junction 182 decreases, as shown by curve 192 in FIG. 5, until it stabilizes at approximately 8 volts at a time T2 which is approximately 10 seconds later than T1; if there is no air flow, the voltage decreases until it stabilizes at approximately 6.2 volts, as shown by curve 194.

The remainder of the circuitry of FIG. 3B, except for relay coil 68, is responsive to the voltage values at junction 182 to effect control of relay coil 80 which, as previously described, controls, through its normally-open contacts 82, burner control module 86. Relay coil 68, which controls blower motor 60 through its normally-open contacts 70, is connected between leads 164 and 166, and is energized wherever thermostat 38 is closed.

The inverting input terminal of a voltage comparator 196 is connected through a resistor R18 to junction 182. The non-inverting input terminal of comparator 196 is connected through a resistor R19 to the junction 197 of resistors R20 and R21 which are connected in series between leads 164 and 166. A filter capacitor C8 is connected across resistor R20. A resistor R22 is connected between the output of comparator 196 and its non-inverting input terminal. Resistors R19 and R22 provide the desired value of hysteresis to comparator 196. A filter capacitor C12 is connected between the output of comparator 196 and lead 166.

The emitter of a PNP transistor Q2 is connected to lead 164. Its collector is connected through resistors R23 and R24 to lead 160, and through a resistor R25 to lead 164. Its base is connected through a resistor R26 to lead 164, and through a current limiting resistor R27 to lead 168.

The non-inverting input terminal of a second voltage comparator 198 is connected to the junction 200 of resistors R23 and R24, and its inverting input terminal is connected through a resistor R28 to junction 182. The output of comparator 198 is connected through a resistor R29 to the inverting input terminal of comparator 196. Preferably, comparators 196 and 198 are integrated in a single device such as an LM393. A capacitor C9, illustrated as connected across the power leads of comparator 198, function as a noise suppressor for both comparators 196 and 198.

The emitter of a PNP transistor Q3 is connected to lead 164, its base is connected through a current limiting resistor R30 to the output of comparator 196, and through a resistor R31 to lead 164. The collector of transistor Q3 is connected to the junction 202 of a capacitor C10 and a fuse F1.

Capacitor C10 is connected through a rectifier CR5 to lead 164, and through fuse F1 and a pair of series connected rectifiers CR6 and CR7 to lead 170, so as to enable capacitor C10 to be charged to the peak voltage of the 25 volt source. Connected in series between capacitor C10 and lead 164 are a rectifier CR8, a pair of parallel-connected resistors R32 and R33, and a parallel-connected branch comprising a capacitor C11, relay coil 80, and a voltage regulator VR1.

In operation, the output of comparator 196 controls conduction of transistor Q3. When the output of comparator 196 is low, transistor Q3 is biased on through resistor R30. Comparator 196 can only sink current, so that when its output is not low, transistor Q3 is biased off. Transistor Q3 is held off by resistor R31. The manner in which the output of comparator 196 is rendered low and not low will be hereinafter described.

When transistor Q3 is non-conductive and terminal 152 is negative with respect to terminal 150, capacitor C10 charges through rectifier CR5, fuse F1, and rectifiers CR6 and CR7 to the peak voltage of the voltage at secondary winding 36. When transistor Q3 is conductive and terminal 152 is positive with respect to terminal 150, capacitor C10 discharges through rectifier CR8, resistors R32 and R33, relay coil 80, and transistor Q3. This charging and discharging of capacitor C10, which occurs at the 60 Hz. frequency of the voltage at secondary winding 36, effects initial and continuing energizing of relay coil 80. Resistors R32 and R33 limit the discharge current. Capacitor C11 provides a hold-in means for relay coil 80 on the alternate half cycles when capacitor C10 is charging. Regulator VR1 limits the voltage across relay coil 80 to 10 volts. Fuse F1 provides a safety function in that, should transistor Q3 become shorted or for some reason, conduct during both half cycles of the 60 Hz. source, fuse F1 would blow due to the excessive current flow therethrough. Rectifiers CR6 and CR7 block current flow when terminal 152 is positive with respet to terminal 150 so as to enable the above described drive circuit for relay coil 80 to function as described.

The output of comparator 196 is dependent upon comparator 198, transistor Q2, and the voltage at junction 182.

Transistor Q2 is biased into conduction during the half cycle of the 60 Hz. source at secondary winding 36 when terminal 152 is positive with respect to terminal 150, and is biased off during the opposite polarity half cycle. When transistor Q2 is off, the voltage at junction 200 of resistors R23 and R24 is approximately 7.25 volts; when transistor Q2 is on, the voltage at junction 200 is approximately 11 volts. Thus, a 60 Hz, square wave signal of a low of 7.25 volts and a high of 11 volts appears at junction 200 and thus at the non-inverting input terminal of comparator 198. The inverting input terminal of comparator 198 is connected through resistor R28 to junction 182. Thus, when the voltage at junction 182 is greater than 11 volts, the output of comparator 198 is low and remains low. When the voltage at junction 182 is below 11 volts but above 7.25 volts, the output of comparator 198 is low when the 60 Hz. signal at junction 200 is 7.25 volts, and is "high" (not low) when the signal at junction 200 is 11 volts, thus resulting in a 60 Hz. high-low signal at the output of comparator 198.

The non-inverting input terminal of comparator 196 is connected through resistor R19 to junction 197 of resistor R20 and R21, which junction is at approximately 7.5 volts. The inverting input terminal of comparator 196 is connected through resistor R18 to junction 182, and through resistor R29 to the output of comparator 198.

As previously described, when the voltage at junction 182 is greater than 11 volts, the output of comparator 198 is constantly low. Resistors R18 and R29 are of such values so that, under this condition, the voltage at the inverting input terminal of comparator 196 is less than the 7.5 volts on its non-inverting input terminal whereby the output of comparator 196 is high. With the output of comparator 196 high, transistor Q3 is biased off. As previously described, when the voltage at junction 182 is below 11 volts but above 7.25 volts, the output of comparator 198 is a 60 Hz. high-low signal. When the 60 Hz. output signal of comparator 198 is high, and the voltage at junction 182 is below 11 volts but above 7.5 volts, which is the voltage on the non-inverting input terminal of comparator 196, the output of comparator 196 is low and transistor Q3 is biased on. When the 60 Hz. output signal of comparator 198 is low, the voltage at the inverting input terminal of comparator 196 is always less than 7.5 volts, due to resistors R18 and R29, so that the output of comparator 196 is then high, causing transistor Q3 to be biased off.

Thus, when the voltage at junction 182 is greater than 11 volts, transistor Q3 is biased off and relay coil 80 is de-energized. When the voltage at junction 182 drops below 11 volts, transistor Q3 is turned on and off at a 60 Hz. rate, effecting energizing of relay coil 80. Should the voltage at junction 182 drop below 7.5 volts, transistor Q3 is biased off and relay coil 80 is de-energized.

It is to be noted that as an added safety feature, comparator 198 will cease providing its 60 Hz, output signal when the voltage at junction 182 drops below 7.25 volts. Specifically, when the voltage at junction 182 is below 7.25 volts, the square-wave signal voltage at the non-inverting input terminal of comparator 198 will always be greater than the voltage on the inverting input terminal of comparator 198 whereby the output of comparator 198 will be constantly high. This constant high, or more particularly, the absence of a 60 Hz. signal on the output of comparator 196, ensures that relay coil 80 cannot be energized.

Referring to FIGS. 1, 2, 3A, 3B, and 6, in operation, when thermostat 38 is closed, relay coil 68 in mass flow sensing circuit 40 is energized, causing its contacts 70 to close. With contacts 70 closed, blower 20 in furnace 10 is energized, causing air to be drawn into combustion chamber 12 through opening 22, causing exhausting of combustion chamber 12 through flue 24, and causing ambient air 66 to flow through sensing device 42.

Also when thermostat 38 closes, maximum voltage appears at junction 182 to effect energizing of heater 132. After approximately 1½ seconds, at a time 13 in FIG. 6, the voltage at junction 182 drops slightly below 11 volts, causing relay coil 80 to be energized in the manner previously described. With relay coil 80 energized, its normally-open contacts 82 close, enabling burner control module 86 to be energized.

Preferably, burner control module 86 includes means to delay energizing of igniter 16 and valve 112 for a specified time, generally referred to as pre-purge time, to enable blower 20 to purge combustion chamber 12 of any unburned fuel or products of combustion. After the pre-purge time has expired, igniter relay coil 96 is energized, causing its normally-open contacts 98 to close. With contacts 98 closed, igniter 16 is energized. When igniter 16 is at or above ignition temperature for gas, valve relay coil 102 is energized, causing its normally-open contacts 104 to close. With contacts 104 closed, gas valve 112 is energized, enabling gas to flow to burner 14 so as to establish flame 122. The presence and absence of flame 122 is monitored by flame probe 18. If flame 122 should not appear within a specified time, generally referred to as lock-out time, burner control module 86 effects deenergizing of igniter 16 and gas valve 112. Preferably, burner control module 86 provides for several attempts at ignition. When flame 122 appears and continues to appear, burner control module 86 provides for continuing burner operation until thermostat 38 opens.

Therefore, at time T3 in FIG. 6, while burner control module 86 is energized and could be initiating energizing of igniter 16, it is preferably providing a pre-purge time wherein igniter 16 and valve 112 are de-energized.

At time T3 in FIG. 6, the voltage at junction 182 has dropped to approximately 11 volts and continues to drop, indicating that air flow sensor 140 is truly being heated to a temperature above that of ambient sensor 134. If there is no air flow through sensing device 42, there is essentially no heat transfer from sensing member 52 which contains air flow sensor 140. Under this condition, very little heat is required from heater 132 to effect the desired temperature differential between ambient sensor 134 and air flow sensor 140, so that the voltage at junction 182 rapidly drops below the value required to effect continued energizing of relay coil 80. Thus, in the absence of air flow, as shown by curve 194 in FIG. 6, the voltage at junction 182 drops below 7.5 volts at a time T4. As previously described, when the voltage at junction 182 drops below 7.5 volts, relay coil 80 is de-energized.

The condition of no air flow through sensing device 42 could be caused by a defective blower 20 or a fully blocked flue 24. That is to say, if blower motor 60 is not energized, or blower wheel 62 does not rotate, or air cannot be forced out of flue 24, there is no pressure differential generated between the area exterior of sensing device 42, which area is at atmospheric pressure, and the interior area in blower housing 58 at which tube 56 is connected. When there is no pressure differential, ambient air 66 cannot be drawn in through sensing device 42. It is to be noted that the time period between time T3 and T4 in FIG. 6 is quite small, for example, less than 1 second. If burner control module 82 provides a pre-purge, time, only the blower 20 was energized during this time period; if no pre-purge the blower 20 and igniter 16 were energized. In either case, no gas has flowed during this time period. Therefore, the time period of less than 1 second does not result in an unsafe condition.

If air flow through sensing device 42 does exist, heat is transferred from sensing element 52 to the air moving thereacross. The amount of heat required to be generated by heater 132 to establish the desired temperature differential between ambient sensor 134 and air flow sensor 140 is therefore greater than the amount of heat required under the condition of no air flow. If there is no restriction in flue 24, the voltage at junction 182 is as shown in curve 192 of FIG. 6. As shown therein, the voltage at junction 182 stabilizes at approximately 8 volts. As previously described, so long as the voltage at junction 182 is above 7.5 volts, relay coil 80 remains energized.

If there is a partial blockage in flue 24, pressure increases in the interior area in blower housing 58 at which tube 56 is connected. This results in a lower mass flow through sensing device 42. Under this condition, less heat is required from heater 132 so that the voltage at junction 182 decreases. When the voltage at junction 182 drops below 7.5 volts, relay coil 80 is de-energized. The value of 7.5 volts at junction 182 occurs when the flue 24 is approximately 85 percent blocked. The 85 percent value is an empirical value of the maximum amount of flue blockage that can exist and yet still ensure safe system operation. Specifically, if greater than 85 percent flue blockage should occur during normal operation when flame 122 exists, such flue blockage could prevent complete combustion and result in generation of undesirable levels of products of incomplete combustion such as carbon monoxide. Thus, so long as blower 20 is functioning properly and flue 24 is less than 85 percent blocked, mass flow sensing circuit 40 maintains burner control module 86 energized.

The following components have been found to be suitable for use in the mass flow sensing circuit 40 described herein.

| COMPONENT | TYPE |
|---|---|
| Q1 | 2N2222 |
| Q2 | MPS6523 |
| Q3 | MPSA77 |
| VR1 | 1N4740 |
| CR1 through CR8 | 1N4004 |
| R1,R26,R27,R31 | 5.1k |
| R2 | 3.6 ohms |
| R3 | 9.1 ohms |
| R4 | 10k |
| R5,R9,R10,R12 | 2k |
| R6 | 113k |
| R7 | 23.2k |
| R8 | 2150 ohms |
| R11 | 20k |
| R13 | 1k |
| R14 | 6.8 ohms |
| R15 | 100 ohms |
| R16,R32,R33 | 200 ohms |
| R17 | 10M |
| R18,R25,R29 | 8450 ohms |
| R19,R20,R21,R23 | 4120 ohms |
| R22 | 100k |
| R24 | 11.8k |
| R28 | 3740 ohms |
| R30 | 1.8k |
| C1,C2,C11 | 220 Mfd. |
| C3,C4,C6,C7,C9,C12 | .01 Mfd. |
| C5,C8 | 22 Mfd. |
| C10 | 33 Mfd. |

It will be obvious to those skilled in the art that various modifications can be made to the above described preferred embodiments without departing from the spirit of the invention. For example, the above described components and related values, such as voltages, can be changed. Additionally, while it has been noted that sensing members 50 and 52 may be identical, or air flow sensing member 52 may be considerably larger in area than ambient sensing member 50, it is also to be noted that ambient sensing member 50 could alternatively comprise a discrete diode, or a specific diode, instead of the inherent diode 134, fabricated on the chip. Moreover, while use of the inherent diodes 134 and 140 is preferred, it is conceivable that resistors 126 and 130 could be used as the ambient and air flow sensors, respectively. In such an arrangement, the circuitry of mass flow sensing circuit 40 would be essentially the same except air flow sensor resistor 130 would be connected to the inverting input terminal of operational amplifier 178, and the output of operational amplifier 174 would be connected to the non-inverting input terminal of operational amplifier 178. This change in circuitry is required because the temperature coefficients of resistance of resistors 128 and 130 are positive, whereas the temperature coefficients of forward voltage drop of diodes 134 and 140 are negative. Furthermore, the voltage at junction 182 could be utilized as an analog input to a microcomputer in burner control module 86 so as to effect, in addition to providing normal system operation as described above, control of a blower that is of the variable speed type.

Other changes and modifications will occur to those skilled in the art. It is therefore intended, by the appended claims, to cover any such changes and modifications as fall within the scope of the invention.

We claim:

1. In a gas burner control system for controlling operation of a furnace wherein the furnace is provided with a blower fluidically connected to the combustion chamber of the furnace, a mass flow sensing device connected fluidically in an air flow path between ambient air and a low pressure portion of a fluid flow path controlled by the blower whereby said ambient air is caused to be drawn in so as to establish an air flow through said sensing device when said blower is operating;

said sensing device including first and second temperature sensitive sensors and a heating means;

said heating means being positioned in heat conductive relationship with said second sensor, and wherein said air flow through said sensing device causes a transfer of heat from said second sensor to the moving air of said air flow; and circuit means connected to said sensing device for initiating operation of said blower, for energizing said heating means so as to establish a predetermined temperature difference between said first and second sensors, and for effecting burner operation when the degree of energizing of said heating means is the degree required to establish said predetermined temperature difference in the presence of the proper mass flow value of said air flow through said sensing devices, wherein said circuit means includes first and second operational amplifiers, wherein said first sensor is connected to one of the inputs of said first amplifier, wherein the other of the inputs of said first amplifier is connected to input and feedback circuit means for establishing a gain greater than 1 for said first amplifier, wherein said second sensor is connected to one of the inputs of said second amplifier, wherein the other of the inputs of said second amplifier is connected to the output of said first amplifier, wherein the output of said second amplifier controls energizing of said heating means, and wherein said input and feedback circuit means includes resistors with selected values of resistance for controlling said output of said second amplifier.

2. The gas burner control system claimed in claim 1 wherein said sensors are identically constructed.

3. The gas burner control system claimed in claim 1 wherein said sensors have different temperature response characteristics.

4. The gas burner control system claimed in claim 1 wherein said resistors establish a value of said predetermined temperature difference that is dependent upon the value of velocity of said moving air of said air flow.

5. The gas burner control system claimed in claim 1 wherein said resistors establish a value of said predetermined temperature difference that is dependent upon the density of said moving air of said air flow.

6. The gas burner control system claimed in claim 1 wherein said resistors establish a constant value of said predetermined temperature difference.

7. The gas burner control system claimed in claim 1 wherein said resistors establish values of said predetermined temperature difference that are slightly less at lower ambient temperatures than at higher ambient temperatures so as to compensate for differences in air density of said moving air of said air flow at different ambient temperatures.

8. The gas burner control system claimed in claim 1 wherein said circuit means further includes voltage regulation means connected in circuit with said sensors, said amplifiers, and said input and feedback circuit means, and wherein said resistors compensate for variations in the output voltage of said voltage regulation means at different ambient temperatures.

9. The gas burner control system claimed in claim 2 wherein said circuit means further includes means for biasing said sensors so that the rate of change in voltage with respect temperature is greater in said second sensor than in said first sensor.

10. The gas burner control system claimed in claim 1 wherein said circuit means further includes a transistor having its base connected to said output of said second amplifier and its emitter-collector circuit connected in series with said heating means.

11. The gas burner control system claimed in claim 10 wherein said circuit means further includes error integrator circuit means connected between the emitter of said transistor and said other of said inputs of said second amplifier.

12. In a gas burner control system for controlling operation of a furnace wherein the furnace is provided with a blower fluidically connected to the combustion chamber of the furnace, a mass flow sensing device connected fluidically in an air flow path between ambient air and a low pressure portion of a fluid flow path controlled by the blower whereby said ambient air is caused to be drawn in so as to establish an air flow through said sensing device when said blower is operating;

said sensing device including first and second temperature sensitive sensors and a heating means;

said heating means being positioned in heat conductive relationship with said second sensor, and wherein said air flow through said sensing device causes a transfer of heat from said second sensor to the moving air of said air flow; and circuit means connected to said sensing device for initiating operation of said blower, for energizing said heating means so as to establish a predetermined temperature difference between said first and second sensors, and for effecting burner operation when the degree of energizing of said heating means is the degree required to establish said predetermined temperature difference in the presence of the proper mass flow value of said air flow through said sensing device, said circuit means including amplifier means for producing an output signal indicative of temperature difference between said first and second sensors, a first transistor responsive to said output signal for controlling energizing of said heating means so as to establish said predetermined temperature difference and so as to establish a voltage at a circuit junction between said first transistor and said heating means which voltage is indicative of the existence of said required degree of energizing of said heating means, and comparator means responsive to said voltage for providing a cyclical output signal, said circuit means further including a power source, a capacitor and a rectifier connected in series across said power source, a relay comprising a relay coil connected in parallel with said rectifier and a set of contacts for effecting said burner operation, and a second transistor connected in parallel with said series-connected to said comparator means and being biased off in response to a high portion of said cyclical output signal so as to enable said capacitor to be charged through said rectifier by said power source, and being biased on in response to a low portion of said cyclical output signal so as to enable said capacitor to discharge through said relay coll and said second transistor thereby to cause said relay coil to energized and effect said burner operation.

* * * * *

UNITED STATES PATENT AND TRADEMARK OFFICE

CERTIFICATE OF CORRECTION

PATENT NO. : 4,712,996

DATED : December 15, 1987

INVENTOR(S) : John T. Adams et al.

It is certified that error appears in the above–identified patent and that said Letters Patent are hereby corrected as shown below:

Col. 3, line 59, change "normally-open" to--normally-closed--;

Col. 11, line 38, change "13" to--T3--;

Col. 15, line 8, change "2" to--1--;
line 11, after "respect" insert--to--;

Col. 16, line 30, after "series-connected" insert--capacitor and rectifier, said second transistor also being connected--.

Signed and Sealed this

Twenty-eighth Day of June, 1988

*Attest:*

*Attesting Officer*

DONALD J. QUIGG

*Commissioner of Patents and Trademarks*